US005904108A

United States Patent [19]

Tanaka et al.

[11] Patent Number: 5,904,108

[45] Date of Patent: May 18, 1999

[54] SEWING MACHINE WITH A LABEL PRINT FUNCTION

[75] Inventors: Takafumi Tanaka, Nagoya; Masayoshi Aoyama, Iwakura, both of Japan

[73] Assignee: Brother Kogyo Kabushiki Kaisha, Nagoya, Japan

[21] Appl. No.: 08/929,428

[22] Filed: Sep. 15, 1997

[30] Foreign Application Priority Data

Nov. 20, 1996 [JP] Japan ..... 8-326028

[51] Int. Cl.[6] ..... D05B 19/12; D05B 81/00

[52] U.S. Cl. ..... 112/102.5; 112/445; 112/470.05

[58] Field of Search ..... 112/102.5, 103, 112/470.06, 475.19, 456, 458, 445, 470.04, 470.02, 470.05; 101/35

[56] References Cited

U.S. PATENT DOCUMENTS

| | | | |
|---|---|---|---|
| 4,622,907 | 11/1986 | Kimura | 112/102.5 |
| 5,181,176 | 1/1993 | Hayakawa . | |
| 5,188,469 | 2/1993 | Nagao et al. . | |
| 5,255,198 | 10/1993 | Yokoe et al. | 112/102.5 X |
| 5,271,344 | 12/1993 | Nishizawa et al. | 112/102.5 |
| 5,386,789 | 2/1995 | Futamura et al. | 112/103 X |
| 5,474,002 | 12/1995 | Goto et al. | 112/102.5 |
| 5,537,939 | 7/1996 | Horton | 112/102.5 X |

*Primary Examiner*—Peter Nerbun
*Attorney, Agent, or Firm*—Oliff & Berridge, PLC

[57] ABSTRACT

A sewing machine capable of embroidery stitching with a label print function. A label printing mechanism is provided for printing on a tape-shaped label, and a ROM card storing a number of stitching designs is detachably mounted on the sewing machine. The sewing machine prepares print data from the stitching data of a stitching design selected from the stitching designs stored in the ROM card, and prints on the label using the label printing mechanism. A character sequence formed of character designs can be printed as descriptive information regarding stitches. Various designs read by an image scanner can also be printed.

24 Claims, 11 Drawing Sheets

SEWING MACHINE WITH A LABEL PRINT FUNCTION

BACKGROUND OF THE INVENTION

1. Field of Invention

The invention relates to a sewing machine with a function of printing information regarding stitches onto a label.

2. Description of Related Art

Electronic-controlled sewing machines have been developed for practical use, in which stitch data regarding a plurality of stitch designs (stitching designs), normally including character designs, object designs and the like, is stored, in correspondence to a number assigned to each stitch design, into a non-volatile memory, such as an internal ROM or an external ROM and the like, provided in a control device. Thus, it is possible to form a stitch design selected by operating a design select key. While such a selected design is produced permanently in a cloth in the form of stitches, the selected design is temporarily displayed in a display of the sewing machine and erased from the display after the stitching operation. The designs formed as described above include, for example, object designs stitch-embroidered as one-point marks, character designs composed of character sequences representing person's names, brand names and the like, and practical-use designs, such as straight patterns, zigzag patterns and the like.

Although such conventional sewing machines are equipped with an indicating device, such as a display, they are not equipped with a printing device that prints and outputs stitching designs or character sequences or the like in relation to stitching designs. Therefore, the conventional sewing machines are unable to print and output stitching designs or character sequences or the like in relation to stitching designs by exploiting the large amounts of information stored or input for producing the stitching designs.

More specifically, if a stitching design is input, a conventional sewing machine merely produces the stitching design in a cloth, leaving a recording operation for an operating person to perform. To record which stitching designs have been completed, the operator needs to take the time to write the designs or character sequences on slips of paper or other recording media to indicate the contents of stitching. Moreover, in a case where a stitched cloth (product) is packed in an opaque paper sheet or bag, so that the product inside cannot be seen from outside, it often becomes necessary to hand-write on a surface of the package the design or character sequence that indicates the content of stitching design of the product inside the package. Further, in many households, a sewing machine is often used to embroider a child's belongings, such as clothes or handkerchiefs, with the child's name or initials. However, for non-clothing articles that cannot be stitched, the child's name or initials must be written by hand.

SUMMARY OF THE INVENTION

Accordingly, it is an object of the invention to provide a sewing machine with a label print function that exploits the information related to stitches formed by the sewing machine and, based on the information, prints out a stitching design or a character sequence or the like related to the stitching design, onto a label.

According to the invention, there is provided a sewing machine with a label print function that is capable of producing stitches in a work cloth. The sewing machine with the label print function has a stitch forming device for forming stitches in the work cloth, and a label printing device for printing on a label on the basis of information related to stitches that the stitch forming device forms. In this structure of the invention, the stitch forming device forms stitches in a work cloth. The label printing device prints a label on the basis of information related to the stitches that the stitch forming device forms. More specifically, the label printing device prints a label showing the design expressed by stitches, a character sequence related to a design expressed by stitches, or a combination of a design and a character sequence related to the design, or other information that clearly indicates the stitched design. The label may have various sizes and shapes, for example, a tape shape. Although the label is preferably a label that, after the printing process, can be separated from a peel covering an adhesive and adhered to a prominent part of the product, the label is not limited to that type of label but may be formed of an ordinary paper. The printing device may be a mono-color printing device or a color printing device.

Because the stitch forming device and the label printing device are provided, the sewing machine is able to print on the label information regarding a stitch-expressed design or a character sequence related to stitches or similar identification information, thereby recording that information faster and more economically than a person can by hand-writing. Furthermore, at the time of printing a stitch-expressed design, information pre-stored for forming stitches can be advantageously exploited.

In the sewing machine with a label print function of the invention, the information related to stitches may include information usable to control the stitch forming device in order to form stitches. If the information usable to control the stitch forming device is design data regarding a stitching design, the sewing machine can prepare print information from the design data and accordingly print the stitching design.

The information related to stitches is used to control the stitch forming device to form stitches. Therefore, if the information is design data of stitching designs, the design data can advantageously be used to prepare print information for printing a stitching design.

The information related to stitches may also include embroidery design information for stitching an embroidery design, and the label printing device may print an embroidery design.

With this structure, the sewing machine prepares information for printing an embroidery design, from the embroidery design information, and accordingly prints the embroidery design using the label printing device. The label printing device may print an overall shape of the embroidery design, instead of a detailed image that shows individual stitches of the embroidery design. Therefore, the structure makes it possible to print an embroidery design by exploiting the embroidery design information.

Since information regarding embroidery designs can thus be printed on a label, the sewing machine conveniently eliminates the need for the troublesome recording operation wherein an operator or someone else must hand-write a label, if such a label is required on a package or the like, for a stitched product. It also becomes unnecessary for an operator to input information for printing an embroidery design because the label printing device uses the pre-stored embroidery design information to print.

The sewing machine with a label print function may further have a design storage device in which information regarding a plurality of stitching designs is stored beforehand, a design selecting device for selecting a stitching design from the stitching designs stored in the design storage device, and a print information preparing device for reading information regarding the stitching design selected by the design selecting device from the design storage device and preparing print information for printing the stitching design. In this structure, information regarding a plurality of stitching designs is pre-stored in the design storage device. When a desired stitching design is selected from the plurality of stitching designs by the design selecting device, the print information preparing device reads information regarding the selected stitching design from the design storage device and prepares information for printing the stitching design.

With the structure wherein the design storage device, the design selecting device and the print information preparing device are provided, it becomes possible to select a desired one of the stitching designs stored in the design storage device and prepare print information from information regarding the selected stitching design in order to print it on a label. Because information regarding stitching designs can thus be printed on a label, the sewing machine conveniently eliminates the need for the troublesome recording operation wherein an operator or someone else hand-writes onto a label, when such a label is required on a package or the like, of a stitched product. It also becomes unnecessary for an operator to input information for printing a stitching design because the stitching design is printed by using the pre-stored stitching design information.

The sewing machine with a label print function may further have a display device capable of indicating information related to stitches formed by the stitch forming device, and a print information preparing device for preparing print information to be used for printing on the basis of the stitch-related information indicated by the display device. The stitch-related information includes designs formed of stitches, character sequence information related to designs formed of stitches, combinations of the designs and the character sequence information, and the like. The display device indicates information related to stitches, and the print information preparing device prepares print information to be used for printing, on the basis of the information indicated on the display device.

With the structure wherein the display device and the print information preparing device are provided, the sewing machine becomes able to indicate or display information related to stitches (designs, character sequence information, combinations of designs and character sequence information, and the like), and to prepare print information for printing the displayed information. Therefore, it becomes possible for an operator to confirm a displayed information before printing.

The label printing device may discharge a printed label in a direction away from a position of stitching by the stitch forming device. If a tape-shaped label is employed, and allowed to move toward the stitching position after being printed, the printed label will likely interfere with the stitching operation. However, because the structure discharges a printed label in a direction away from the stitching position, the printed label will not interfere with the stitching operation.

With the structure wherein the label printing device discharges a printed label in a direction away from the stitching position of the stitch forming device, a printed label will not move toward the stitching position to interfere with the stitching operation even if the label used is a tape-shaped label.

The label printing device may print on an iron-printable label. The iron-printable label is a label that can be applied to a surface of another article (a garment, a cloth or the like) by heating it with an iron after it has been provided with a print.

If the label printing device is structured to print on an iron-printable label, it becomes possible to apply a design printed on a label to a surface of another article (a garment, a cloth or the like) by iron printing. This structure may advantageously be applied if it is desired to produce a design with a high efficiency and a low cost rather than an elaborate stitched design.

The sewing machine with a label print function may further have a stitching time calculating device for calculating a stitching time needed to produce a stitching design, and a display device for indicating the stitching time calculated by the stitching time calculating device. When the stitching time calculating device calculates a stitching time needed to produce a stitching design, the stitching time is indicated on the display device. If the stitching time needed to produce a stitching design is found to be inconveniently long, it is possible to print the design onto an iron-printable label and iron-print the printed design onto an object, instead of stitching the design.

With the structure wherein the stitching time calculating device for calculating a stitching time needed to produce a stitching design and the display device for indicating the calculated stitching time are provided, it becomes possible to indicate a time needed to produce a stitching design. If the stitching time needed to produce a stitching design is inconveniently long, it is possible to print the design onto an iron-printable label and iron-print the printed design onto an object, instead of stitching the design.

The sewing machine with a label print function may further have a stitching design storage device for receiving information regarding a stitching design selected by the design selecting device and continuing to store the information even after the supply of power is discontinued, and a print information preparing device for preparing print information to be used for printing from the stitching design information stored in the stitching design storage device. In this structure, the stitching design storage device continues to store a selected stitching design even after the supply of power to the sewing machine is discontinued, and the print information preparing device prepares print information to be used for printing from the stitching design information stored in the stitching design storage device.

With the structure wherein the stitching design storage device for continuing to store information even after a power supply is discontinued, and the print information preparing device, are provided, the information stored regarding a selected stitching design is conveniently retained during power-off, so that the stored information can be used to prepare print information for printing the same stitching design again.

The sewing machine with a label print function may further have an external storage device for receiving and storing information regarding a stitching design selected by the design selecting device, and a print information preparing device for reading stitching design information from the external storage device and preparing print information to be used for printing. The external storage device is detachably mounted in the sewing machine. In this structure, the external storage device receives and stores information regarding a stitching device selected, and the print information preparing device reads stitching design information from the external storage device and prepares print information to be used for printing. The external storage device may include a RAM card, a flash memory card, or the like.

With the structure wherein the external storage device for storing information regarding a stitching design selected by the design selecting device, and the print information preparing device for preparing print information from stitching design information stored in the external storage device, are provided, it becomes possible to store information regarding a selected stitching design and prepare print information from the stored information. Thereby, information stored regarding a selected design can be conveniently used to print the same design again. Furthermore, an external storage device can be conveniently shared by a plurality of sewing machines with a label print function.

The information regarding a plurality of stitching designs stored in the design storage device may include information of a group of characters sorted separately for a plurality of typefaces, and the design selecting device may include a typeface selecting device for selecting a typeface and a character selecting device for selecting a character. Thereby, at the time of selecting a stitching design, a typeface can be selected by the typeface selecting device, and a character can be selected by the character selecting device.

With the structure wherein the information regarding a plurality of stitching designs stored in the design storage device includes information of a group of characters sorted separately for a plurality of typefaces, and wherein the design selecting device includes a typeface selecting device for selecting a typeface and a character selecting device for selecting a character, it becomes possible to select a desired character in a desired typeface at the time of selecting a stitching design and to accordingly print the design.

The information regarding a plurality of stitching designs stored in the design storage device may include information regarding a plurality of object designs. The term "object design" herein refers to, for example, designs in the form of one-point marks or the like (various animal designs, various commodity designs, various vehicle designs, and the like). If information regarding a plurality of such object designs is included in the information regarding a plurality of stitching designs stored in the design storage device, it becomes possible to select a desired object design from the stored object designs and print it on a label.

With the structure wherein the information regarding a plurality of stitching designs stored in the design storage device includes information regarding a plurality of object designs, it becomes possible to select a desired object design from the stored object designs and print the selected object design on a label.

BRIEF DESCRIPTION OF THE DRAWINGS

A preferred embodiment of the invention will be described in detail with reference to the following figures wherein:

FIG. 14 is a plan view of a label printed with characters, an object design and the like.

DETAILED DESCRIPTION OF PREFERRED EMBODIMENTS

A preferred embodiment of the invention will be described in detail hereinafter with reference to the accompanying drawings.

In this embodiment, the invention is applied to an electronic-controlled zigzag sewing machine (a stitch forming device) equipped with an embroidering device and a print mechanism for printing on a label.

Figure 1:
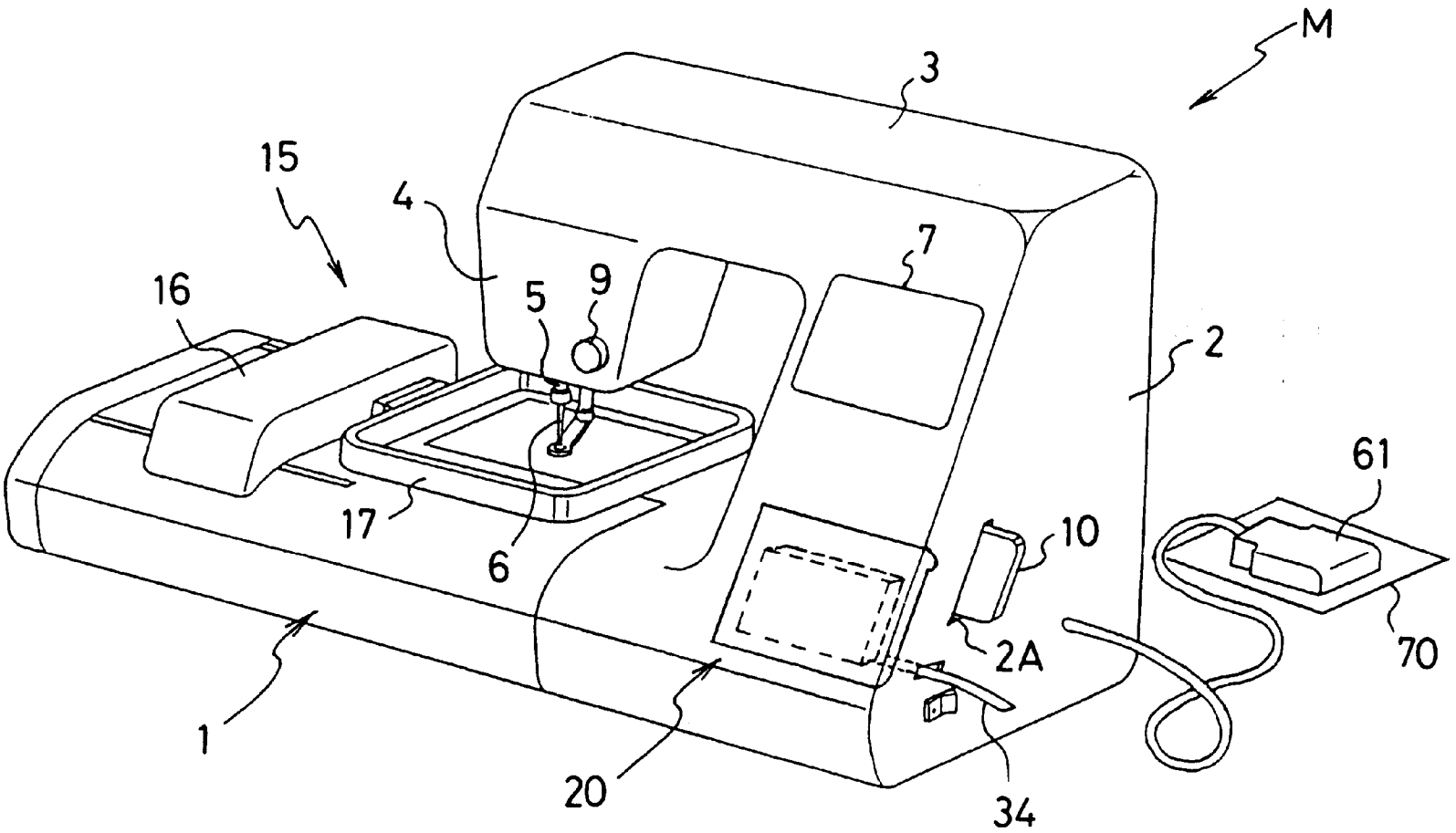
FIG. 1 is a perspective view of an electronic-controlled zigzag sewing machine according an embodiment of the invention.
Figure 3:
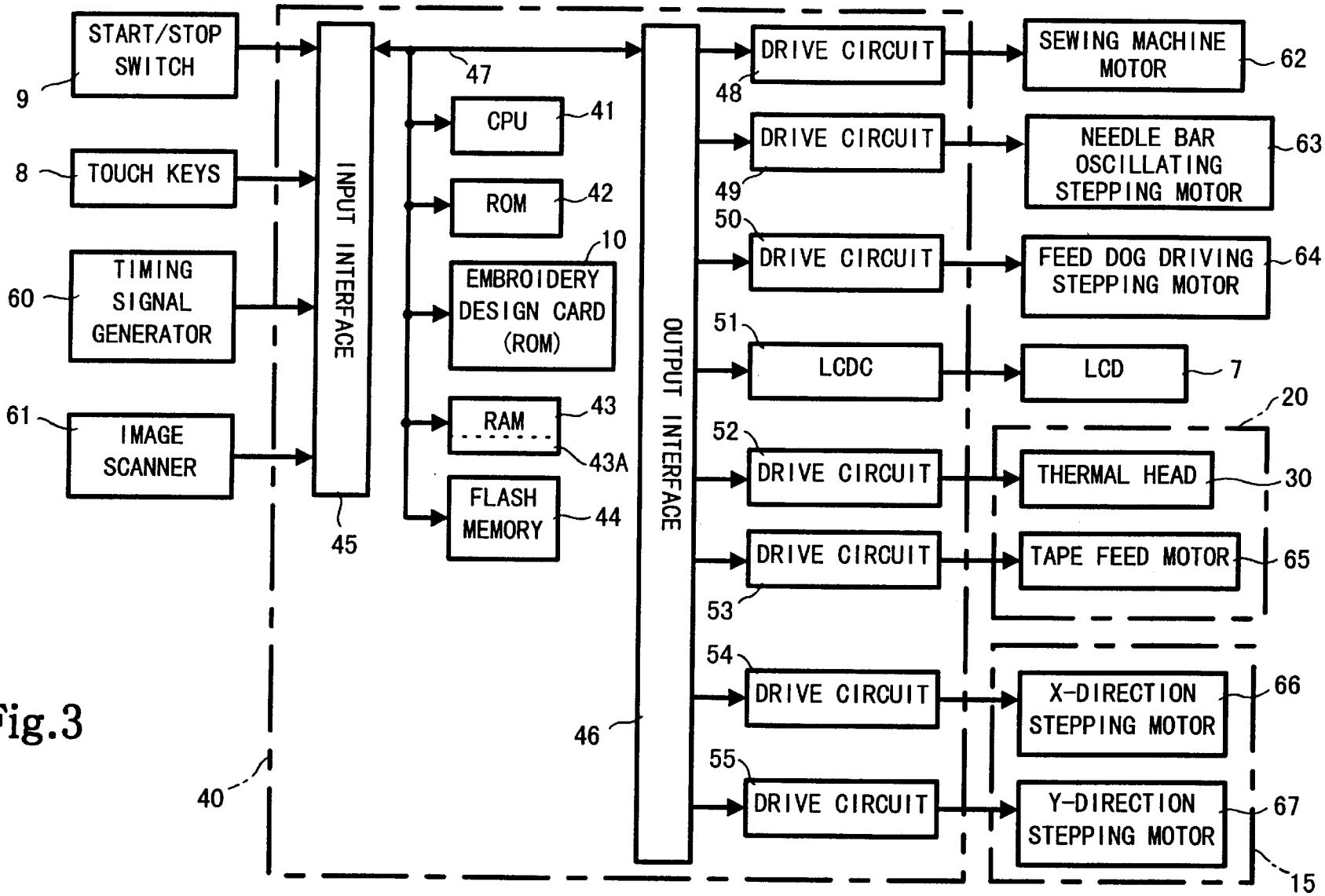
FIG. 3 is a block diagram of a control system of the electronic-controlled zigzag sewing machine.
Figure 4:
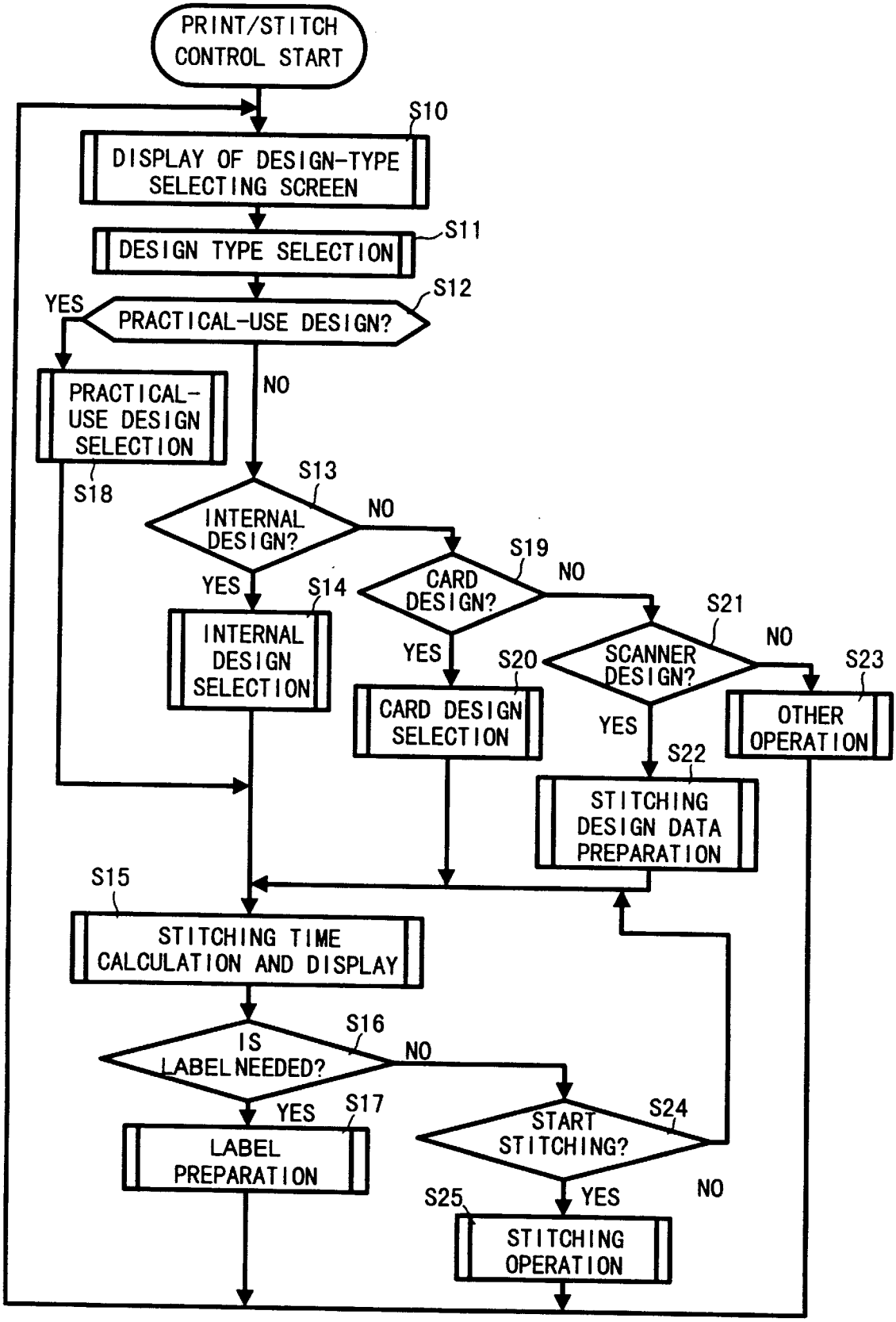
FIG. 4 is a flowchart illustrating a print/stitch control routine.

Referring to FIGS. 1 and 3, an electronic-controlled zigzag sewing machine M is formed of a sewing machine bed portion 1, a support column portion 2 standing from a right side end of the bed portion 1, an arm portion 3 extending from the support column portion 2 to the left so as to face the bed portion 1. The bed portion 1 is provided with a feed dog vertically moving mechanism (not shown) for moving a feed dog up and down, a feed dog forward-rearward moving mechanism (not shown) for moving the feed dog forward and rearward, and the like.

The arm portion 3 is provided with a needle bar drive mechanism for upwardly and downwardly driving a needle bar 5 to whose lower end a sewing needle 6 can be fitted, a needle bar oscillating mechanism for oscillating the needle bar 5 perpendicularly to a cloth-feeding direction, a thread take-up lever drive mechanism (not shown) for vertically driving a thread take-up lever synchronously with the vertical movements of the needle bar 5, and the like. The feed dog vertically moving mechanism, the needle bar drive mechanism and the thread take-up drive mechanism are driven by a sewing machine motor 62. The feed dog forward-rearward moving mechanism is driven by a feed dog driving stepping motor 64. The needle bar oscillating mechanism is driven by a needle bar oscillating stepping motor 63.

A liquid crystal display 7, capable of displaying embroidery designs, various messages and the like, is disposed in the support column portion 2. A start/stop switch 9 for instructing the start and stop of a stitching operation is provided in a head portion 4. A front surface of the display 7 is provided with touch keys 8 formed of transparent electrodes corresponding to positions at which a plurality of embroidery designs and function names indicating the content of functions are displayed. Therefore, a desired embroidery design can be selected or a desired function can be instructed by pressing a touch key 8 corresponding to the embroidery design or function name.

Formed in a side wall portion of the support column portion 2 is a card slot 2A into which various kinds of embroidery design cards 10 (external storage devices) can be detachably set.

An embroidering device 15 for producing various embroidery designs is detachably mounted on the bed portion 1. The embroidering device 15 has an embroidery table 16 that is movable separately in a Y direction parallel to the cloth-feeding direction and the reverse cloth-feeding direction and in an X direction perpendicular to the Y direction. The embroidery table 16 is provided with a detachable embroidery frame 17 for supporting a work cloth.

An X-direction stepping motor 66 for driving the embroidery table 16 in the X direction and a Y-direction stepping motor 67 for driving the embroidery table 16 in the Y direction are disposed inside the bed portion 1, under the embroidering device 15. Through cooperation of the vertical movements of the needle bar 5 and the driving of the two stepping motors 66, 67 caused by drive signals from the sewing machine M, various embroidery designs can be formed in a work cloth supported by the embroidery frame 17.

The embroidery design card 10 stores stitching data and display data regarding a plurality of character designs and object designs, such as animal and vehicle designs, other than the embroidery designs stored in a ROM 42 of the sewing machine M.

A label printing mechanism 20 (a label printing device) for printing embroidery designs and the like on a label is provided in a lower end portion of the support column portion 2.

Figure 2:
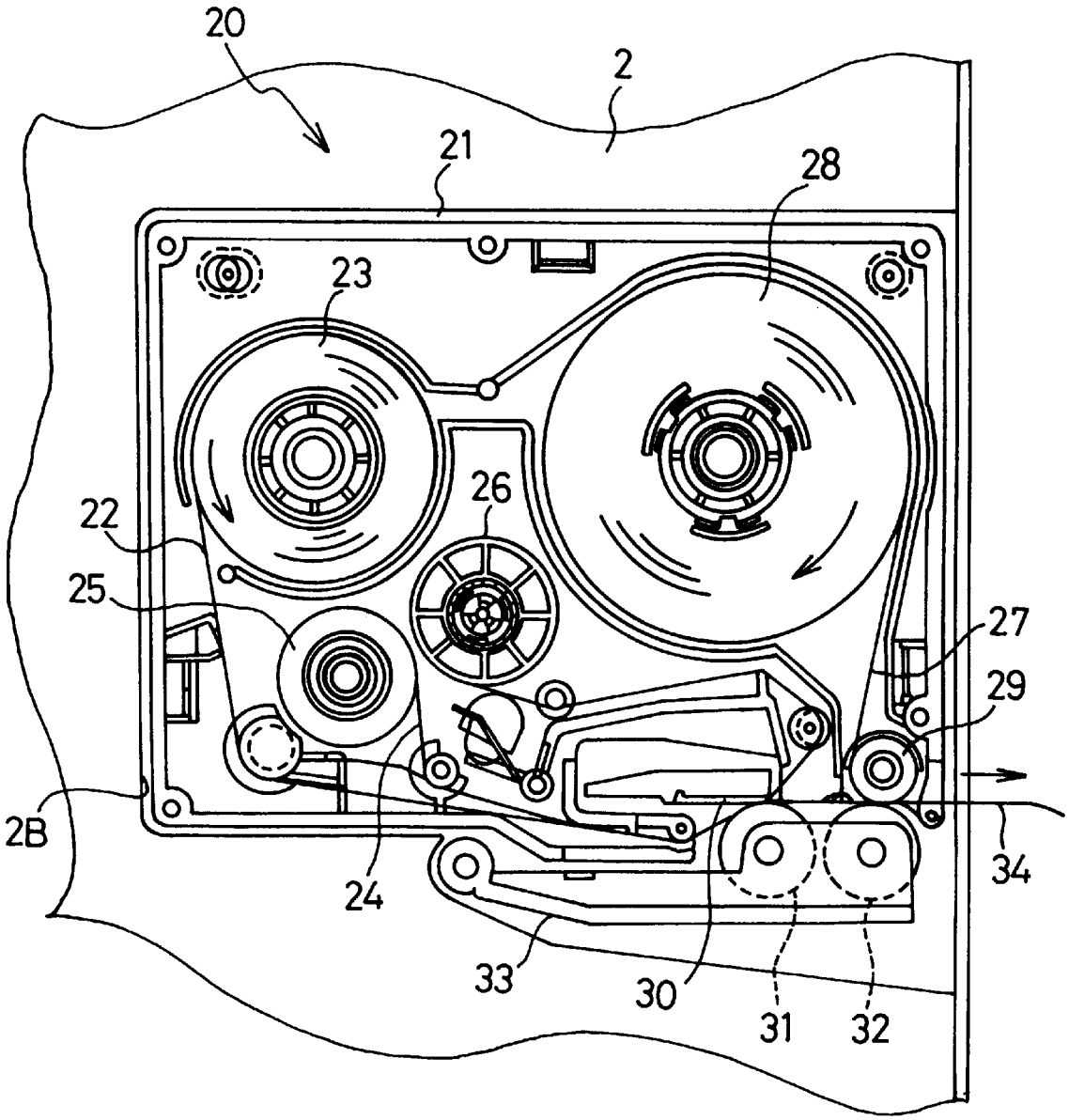
FIG. 2 is a plan view of a label printing mechanism.

The label printing mechanism 20 will now be described. A rectangular tape cassette 21 is detachably inserted in a tape cassette receiving recess 2B formed in the support column portion 2. Disposed in the tape cassette 21 are, as shown in FIG. 2, a rotatable tape spool 23 around which a print tape 22 of, for example, about 24 mm wide formed of a transparent film is wound, a rotatable ribbon feed spool 25 around which an ink ribbon 24 is wound, a rotatable wind-up spool 26 for winding up the ink ribbon 24, a rotatable feed spool 28 around which a double-sided adhesive tape 27 having the same width as the print tape 22 is wound with a peel strip laid on the outer side of the double-sided adhesive tape 27, and a rotatable joining roller 29 for joining the print tape 22 and the double-sided adhesive tape 27.

A thermal head 30 is provided standing at a position where the print tape 22 and the ink ribbon 24 are superposed on each other. A platen roller 31 pressing the print tape 22 and the ink ribbon 24 against the thermal head 30, and a convey roller 32 pressing the print tape 22 and the double-side adhesive tape 27 against the joining roller 29, are rotatably journaled to a support member 33 pivotably supported on the support column portion 2. The thermal head 30 has a heater element group of 128 heater elements arranged in vertical directions.

The joining roller 29 and the wind-up roller 26 are synchronously rotated in predetermined directions by a tape feed motor 65 which operates in a predetermined rotational direction. When the heater element group is energized while the rollers are being rotated, a character, a symbol, or an embroidery design is printed on the print tape 22 by a plurality of lines of dots. The double-sided adhesive tape 27 is then joined to the printed surface of the print tape 22, thereby forming a label 34. The label 34 is conveyed out of the support column portion 2. The label printing mechanism 20 is described in detail in U.S. Pat. No. 5,188,469, the disclosure of which is incorporated herein by reference.

A control system for the electronic-controlled zigzag sewing machine is structured as shown in the block diagram of FIG. 3. The start/stop switch 9, the touch keys 8, a timing signal generator 60 and a hand-held image scanner 61 are separately connected to an input interface 45 of a control device 40. The timing signal generator 60 is provided near a sewing machine main shaft rotated by the sewing machine motor 62, and generates various timing signals that include a timing signal for the top position of the needle, a timing signal for the bottom position of the needle, and the like. The hand-held image scanner 61 is used to read an image formed on a document 70 (FIG. 1).

An output interface 46 of the control device 40 is separately connected to a drive circuit 48 for driving the sewing machine motor 62, a drive circuit 49 for driving the needle bar oscillating stepping motor 63, a drive circuit 50 for driving the feed dog driving stepping motor 64, and a liquid crystal display controller (LCDC) 51 for controlling contents displayed on the liquid crystal display (LCD) 7.

The output interface 46 is also connected separately to a drive circuit 52 for driving the thermal head 30, and a drive circuit 53 for driving the tape feed motor 65. The thermal head 30 and the tape feed motor 65 constitute a portion of the label printing mechanism 20.

The output interface 46 is further connected separately with a drive circuit 54 for driving the X-direction stepping motor 66, and a drive circuit 55 for driving the Y-direction stepping motor 67. The X-direction stepping motor 66 and the Y-direction stepping motor 67 constitute a portion of the embroidering device 15.

The control device 40 is made up of the CPU 41, the input interface 45 and the output interface 46 connected to the CPU 41 by a bus 47, such as a data bus, the ROM 42, the embroidery design card (ROM) 10, a RAM 43, and a flash memory (an embroidery design storage device) 44.

The ROM 42 stores a stitching control program for driving the sewing machine motor 62, the needle bar oscillating stepping motor 63 and the feed dog driving stepping motor 64 on the basis of stitching data of an embroidery design selected, a print control program for driving the thermal head 30 and the tape feed motor 65 on the basis of dot pattern data of an embroidery design selected, a control program for print/stitch control (described below) according to the invention, and the other controlled operating components. The RAM 43 has a dot data memory 43A for developing dot patterns of a plurality of embroidery designs to be used for printing, various memories for pointers, counters and flags, various memories for temporarily storing results of operations by the CPU 41, and the like.

Display data and stitching data regarding each of a plurality of practical-use designs are stored as practical-use design information in a data area of the ROM 42 assigned for storage of data regarding embroidery designs. Furthermore, display data and stitching data regarding each of character designs and symbol designs are stored as character and symbol information in such a data area of the ROM 42. Further, display data and stitching data regarding each of object designs are stored as object design information. The display data herein is dot pattern data. The stitching data includes data composed of a plurality of needle location data, and data composed of block data regarding a plurality of divided quadrilateral blocks. The block data includes data defining four points that define a block having the shape of a rectangle, trapezoid or the like, and data regarding thread density.

A routine of print/stitch control performed by the control device 40 of the sewing machine M will be described with reference to the flowcharts of FIGS. 4–7. In the flowcharts, reference characters Si (i=10, 11, 12, . . . ) represent operation steps.

Figure 8:
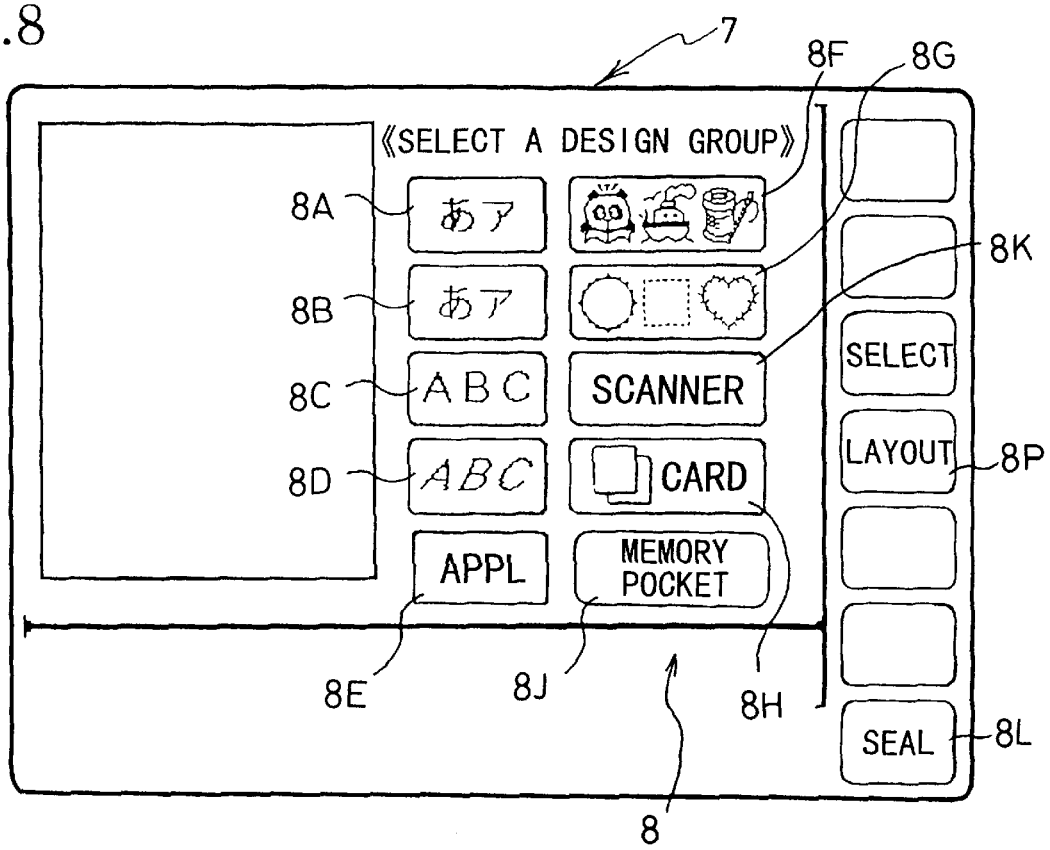
FIG. 8 shows an example display of a design-type selecting screen.
Figure 9:
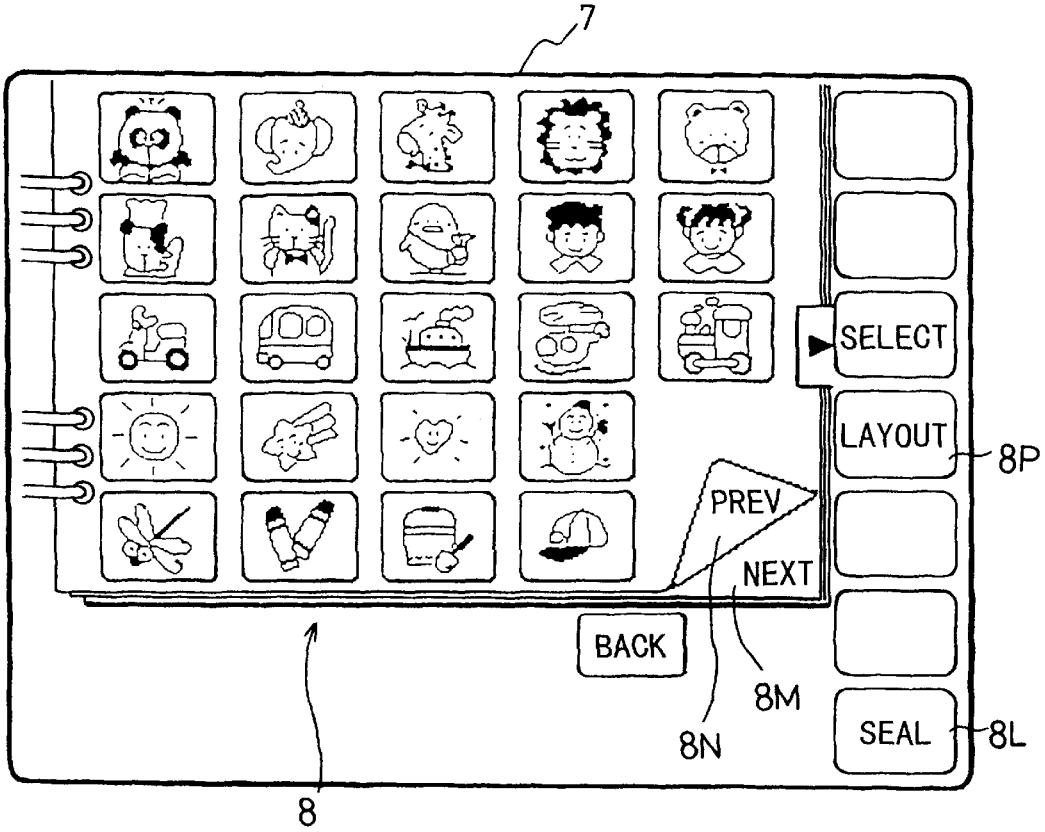
FIG. 9 shows an example display of a plurality of object designs.

When the sewing machine M is powered on, a design-type selecting screen is displayed on the display 7 (S10). For example, a selecting screen such as shown in FIG. 8, is displayed, including select keys 8A–8D for selecting character designs separately for typefaces, a select key 8E for selecting practical-use designs, select keys 8F, 8G for selecting object designs, and a select key (card key) 8H for selecting embroidery designs stored in embroidery design cards 10. A plurality of character designs or object designs selected using the corresponding select keys can be stored into the flash memory 44 by operating a "MEMORY POCKET" select key 8J, so that the design data will be retained in storage even if the supply power is discontinued.

A desired embroidery design type is selected by pressing a touch key 8A–8H (S11). If an object design type or a character design type is selected (NO in step S12) and, further, an internal design stored in the ROM 42 is selected (YES in step S13), then an internally-stored design select operation (see FIG. 5) for selecting the desired object or character design is performed (S14).

Figure 5:
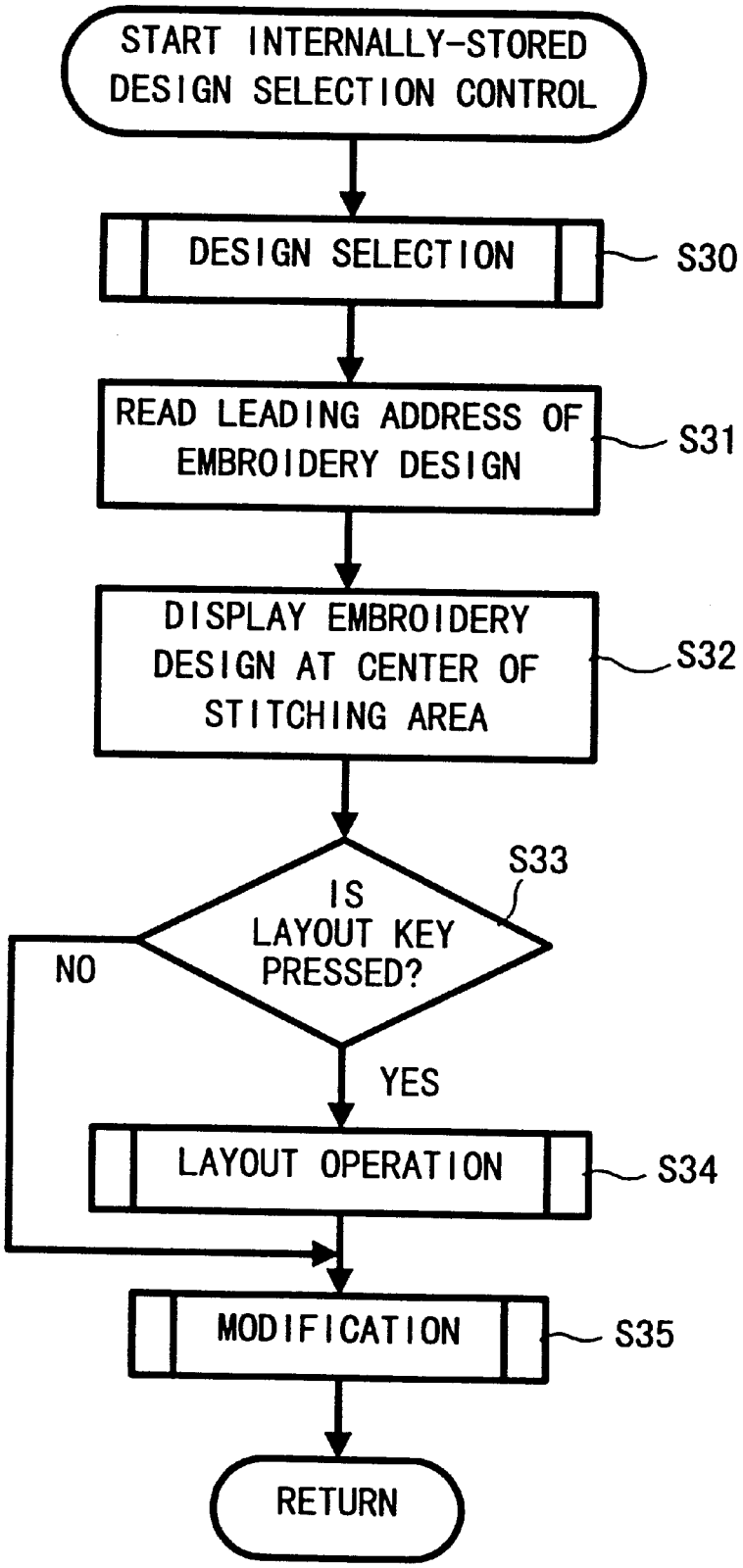
FIG. 5 is a flowchart illustrating an internally-stored design selecting operation control routine.

When this control operation starts, a plurality of embroidery designs are displayed on the display 7, thereby making it possible to perform a design select operation for selecting a desired design (S30 in FIG. 5).

Figure 10:
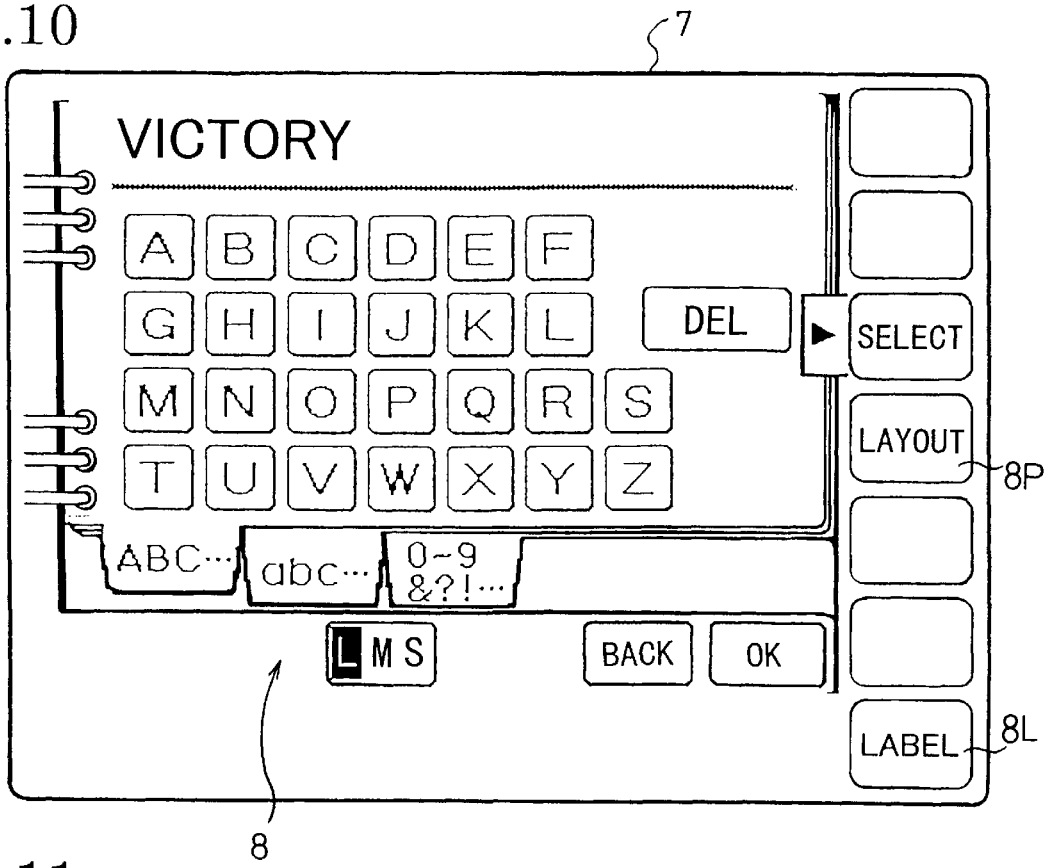
FIG. 10 shows an example display of a plurality of character designs.

For example, if an object design has been selected as a design type, a plurality of object designs are displayed in a matrix arrangement, so that a desired object design can be selected therefrom by pressing a touch key 8. By pressing a next page key 8M and a previous page key 8N, an operator can view object designs over a plurality of pages to select a desired object design. If character design has been selected as a design type, a plurality of character designs are displayed in a matrix arrangement as shown in FIG. 10, so that a desired character design can be selected by pressing a touch key 8.

Figure 11:
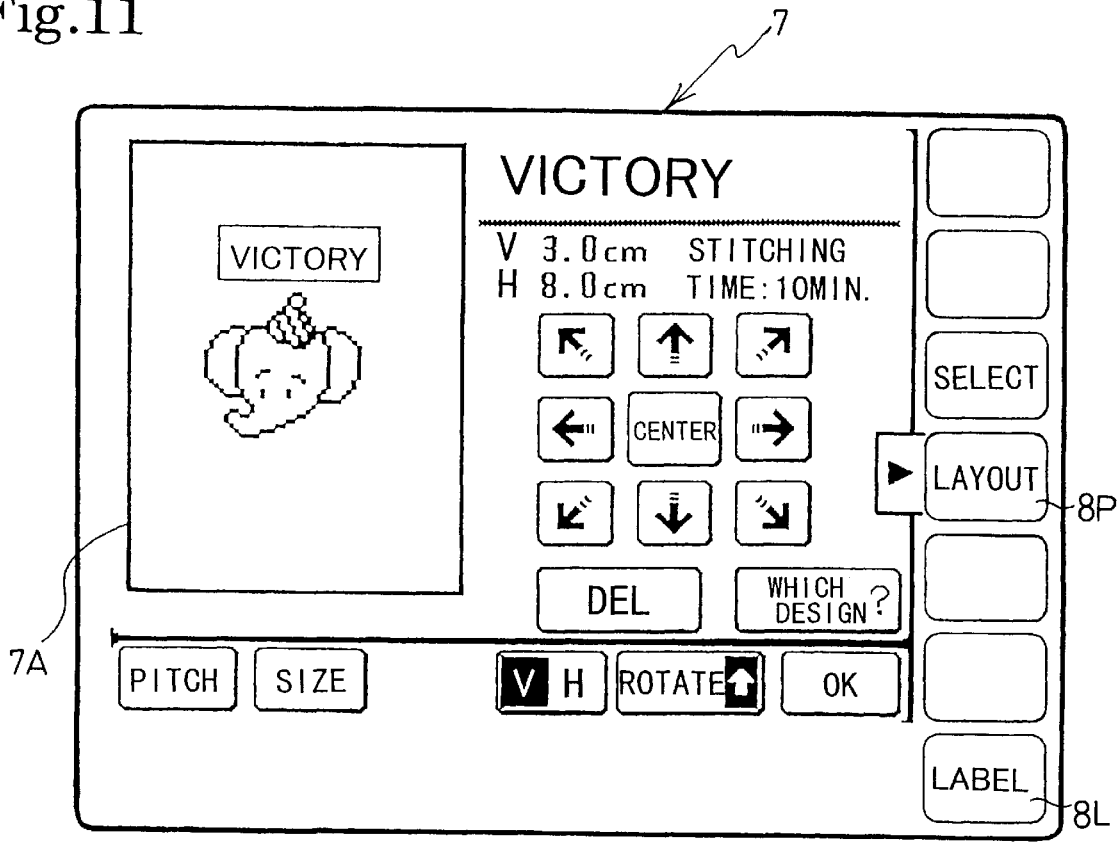
FIG. 11 shows an example of a layout screen.

Subsequently, the leading address of the display data of the selected embroidery design is read by the CPU 41 (S31). Based on the leading address, the display data is read, and the embroidery design is displayed in a central portion of a stitching area 7A of the display 7 (S32). For example, if an elephant embroidery design is selected, an embroidery design image representing an elephant is displayed in a central portion of the stitching area 7A as shown in FIG. 11. If a layout key 8P is then pressed (YES in S33), a layout screen as shown in FIG. 11 is displayed, whereby a layout operation for, for example, moving the embroidery design to a desired position in the stitching area 7A, can be performed (S34). After modification, if necessary, is performed, such as design enlargement or reduction, rotation, and the like (S35), the control operation ends. Operation then returns to step S15 of the print/stitch control.

In the print/stitch control, a stitching time needed for the embroidery design is calculated based on the number of stitches, the amount of feed for each needle movement and the like, and the stitching time thus calculated is displayed on the display 7 (S15). It is subsequently determined whether a label key 8L displayed on the display 7 has been pressed (S16). If preparation of a label is instructed (YES in S16), the label preparing operation (see FIG. 6) is performed (S17). Step S15 corresponds to calculating and displaying a stitching time.

Figure 6:
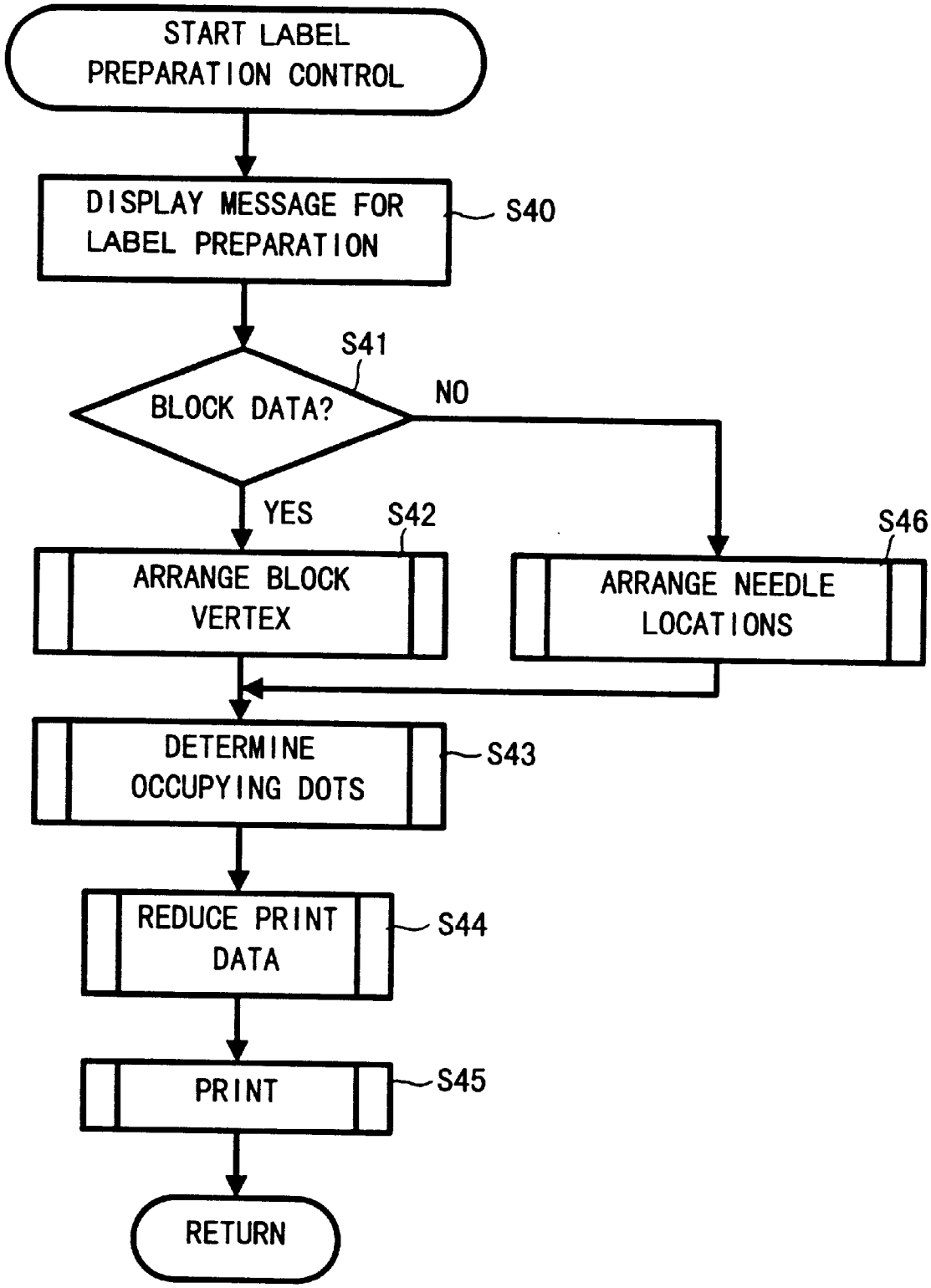
FIG. 6 is a flowchart illustrating a label preparing operation control routine.

When the label preparation control is started, a message "LABEL BEING PREPARED" is first displayed on the display 7 (FIG. 6, S40). If the selected embroidery design is expressed by block data (YES in S41), block vertex arrangement operation is performed (S42).

Figure 7:
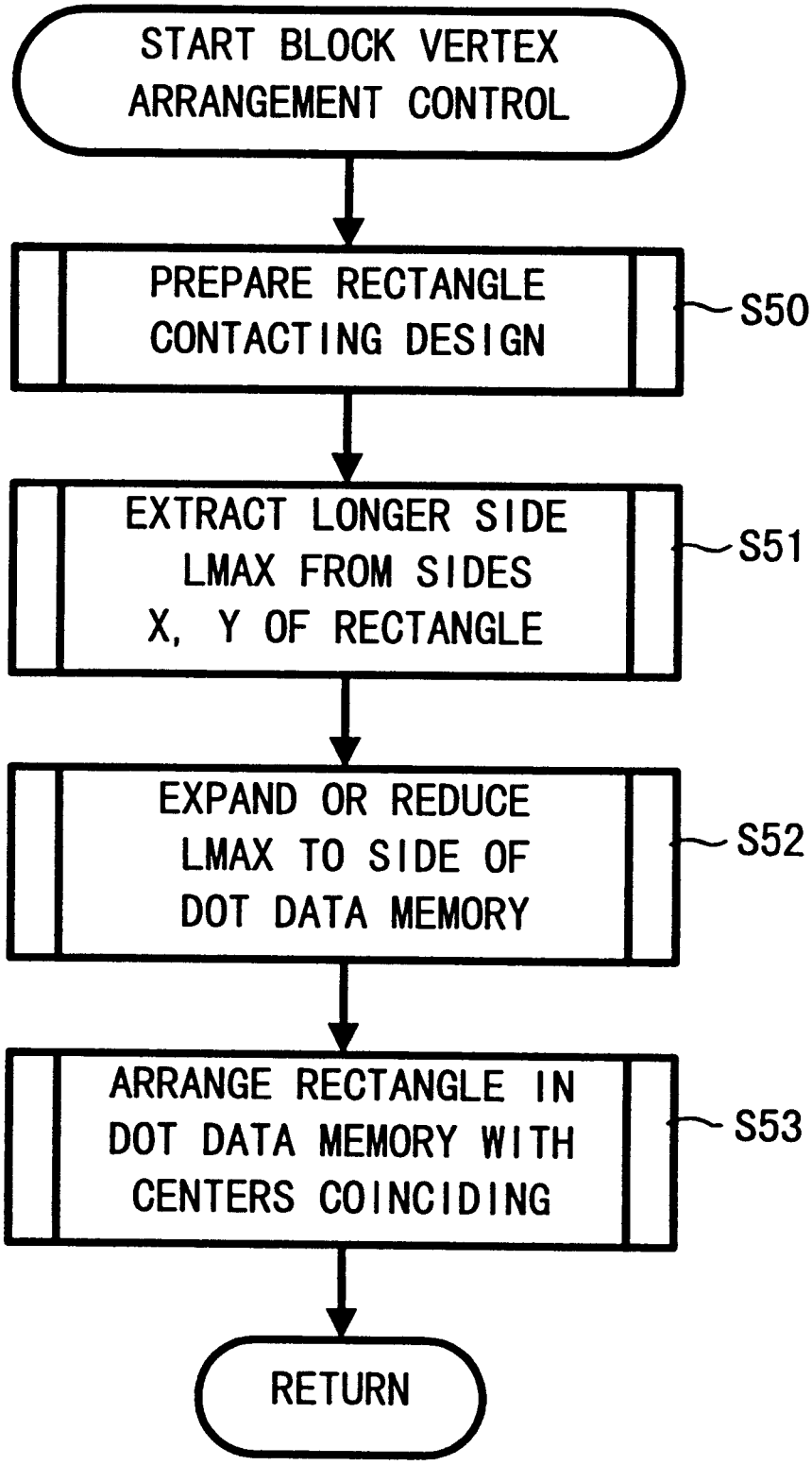
FIG. 7 is a flowchart illustrating a block vertex arranging operation control routine.

When the block vertex arrangement operation is started, a rectangle that contacts the outline of the embroidery design expressed by a plurality of block data is determined (FIG. 7, S50). The greater one of the X-directional and Y-directional side dimensions of the rectangle is determined as Lmax (S51). The dimension Lmax is expanded or reduced so that Lmax becomes equal to or less than the corresponding side (X-directional or Y-direction side) of a storage area provided for representation of an embroidery design in the dot data memory 43A (S52). The dot data of the embroidery design is developed in the storage area of the dot data memory 43A in such a manner that the center of the rectangle coincides with the center of the storage area (S53). Then, this control operation is ended, and operation returns to step S43 of the label preparation control.

Figure 12:
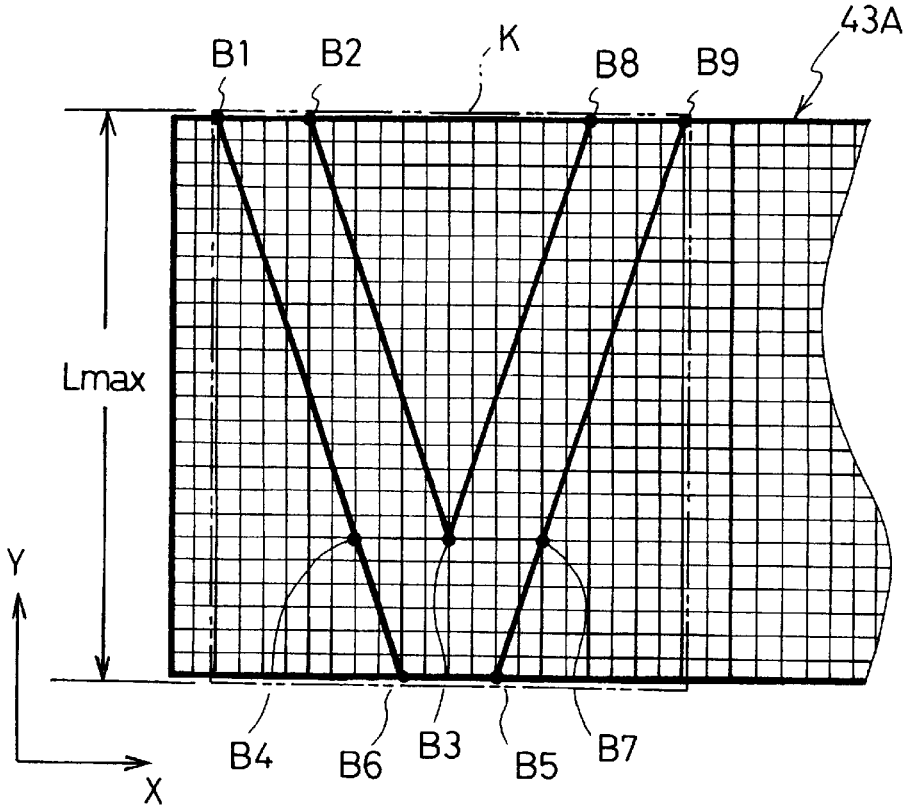
FIG. 12 illustrates block data to be developed in a dot data memory.

In an example case, shown in FIG. 12 wherein a character design "V" is composed of three block data (B1, B2, B3, B4), (B4, B7, B5, B6), (B8, B9, B7, B3), a rectangle K (indicated by a two-dot line) that contacts the three blocks is determined. The Y-directional length (Lmax) of the rectangle K is expanded or reduced so that Lmax becomes equal to the Y-directional length of the dot data memory 43A. The rectangle K is thereby arranged in the storage area of the dot data memory 43A.

Subsequently in step S43 of the label preparation control, the block data of the embroidery design is expanded and reduced, and arranged in a development area designated by the rectangle K within a storage area for an embroidery design in the dot data memory 43A. Occupying dot determining operation is performed to develop "black" dots within the block data, thereby preparing dot pattern data for printing (S43).

Figure 13:
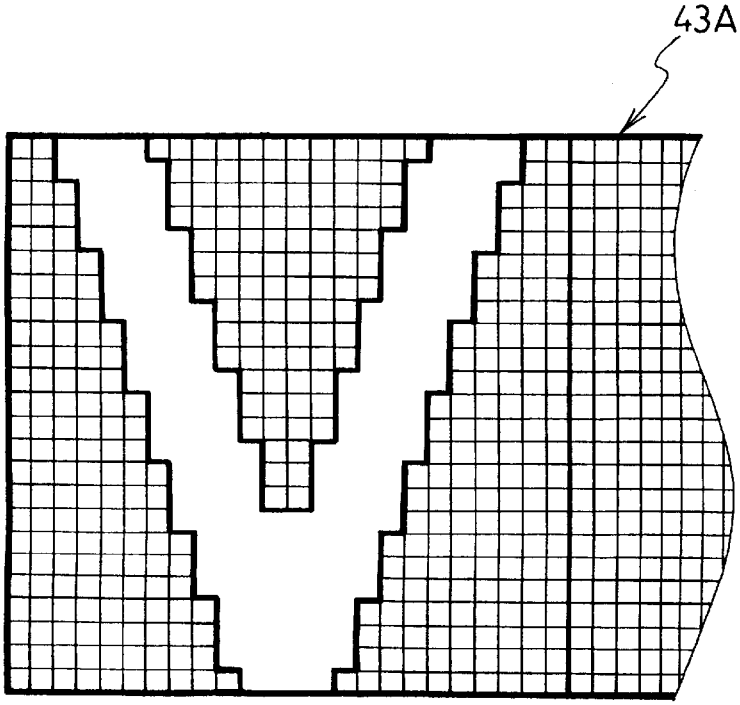
FIG. 13 illustrates dot pattern data developed in the dot data memory.

In an example case shown in FIG. 13, "black" dot data is developed at dot forming matrix positions within the outline of the character design "V" composed of the three block data. Dot pattern data for printing is thereby prepared.

Subsequently, based on the tape width of the print tape 22 contained in the tape cassette 21 set in the label printing mechanism 20, the printing dot pattern data is reduced so that the printing will be completed within the tape width (S44). The thus-reduced dot pattern data is then transferred to the label printing mechanism 20. After the thermal head 30 of the label printing mechanism performs printing, a dot line at a time (S45), the control operation ends, and operation returns to step S10 of the print/stitch control.

Figure 14:
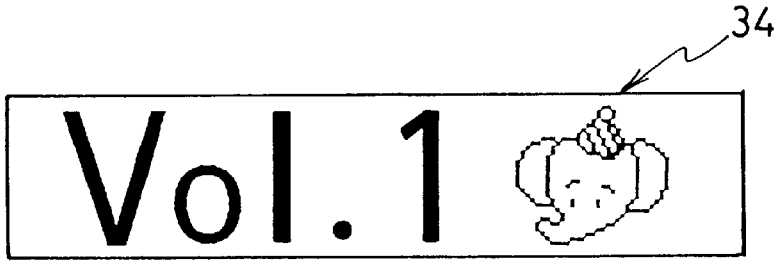

In an example case where "Vol. 1 (elephant)" is selected as the embroidery design as indicated in FIG. 14, the embroidery design is printed on the print tape 22 of 24 mm in tape width contained in the tape cassette 21. The label 34 is thereby prepared.

If the data regarding the selected embroidery design is data of needle location for each stitch (No in S41), the needle location points expressed by the needle location data are expanded or reduced and arranged in the dot data memory 43A (needle location points arrangement in step S46). Then, the above-described operation of steps S43–S45 are performed. Steps S41–S44 and step S46 correspond to a print information preparing device.

If the card key 8H for instructing to use an embroidery design card 10 is pressed to select an embroidery design stored in the embroidery design card (NO in S13, YES in S19), a design selecting operation is performed (S20) to select a desired embroidery design from a plurality of embroidery designs stored in the embroidery design card 10, in a similar manner as in step S14. Then, the operation through step S15 and the following steps is performed as described above.

If a scanner key 8K, superimposed on a touch key 8, is pressed to print and stitch an image read by the image scanner 61 from a document 70 (NO in S13, NO in S19, and YES in S21), a stitching data preparing operation is performed (S22) based on the image read by the image scanner 61. Then, the operation of step S15 and the following steps is performed as described above.

In the stitching data preparing operation, the image read by the image scanner 61, for example, an object graphic extracted from a magazine or an advertisement, is divided into a plurality of blocks, and the coordinates of four defining points for each block are determined. On major and minor sides of each block defined by the defining points and facing each other, a plurality of sequential needle locations are determined between a stitching start point to a stitching end point on the basis of a pre-set thread density. Such an operation is described in U.S. Pat. No. 5,181,176, the disclosure of which is incorporated by reference herein. Steps S14, S20, the touch keys 8 and the like, constitute a design selecting device.

If any touch key 8, other than the design-type keys 8A–8G, the scanner key 8K and the card key 8H is pressed (NO in S13, NO in S19, and NO in S21), an operation corresponding to the pressed key 8 is performed (S23). Then the operation returns to step S10.

If the start/stop switch 9 is operated (YES in S24) after an embroidery design has been selected as described above, the embroidering device 15 is driven to perform embroidery design stitching operation (S25) based on the stitching data of the selected embroidery design. Then the operation returns to step S10.

If a practical-use design type of embroidery design is selected (YES in step 12), a plurality of practical-use designs are displayed on the display 7, whereby the practical-use design selecting operation can be performed to select a desired practical-use design therefrom (S18). Then the operation of step S15 and the following steps is performed as described above.

The above-described embodiment may be modified, for example, as described below.

Figure 15:
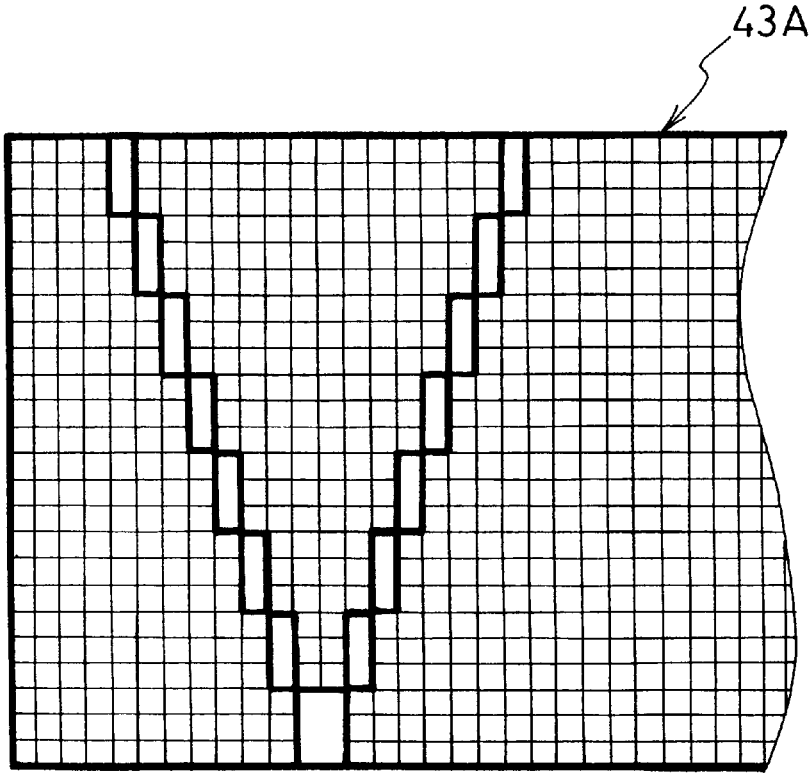
FIG. 15 illustrates dot pattern data of linear stitching data.

If a selected embroidery design is a design that is expressed by linear stitching data for a straight line, a curved line or the like, and that is produced by embroidery stitching while a work cloth is being fed by the feed dog, the printing dot pattern data of the linear design, for example, the design "V" as shown in FIG. 15, may be obtained by determining the dots on coordinates on a straight line as "black" dot data when the stitching data of the linear design is developed in the dot data memory 43A.

It is also possible to provide an additional card memory (RAM card) on the bus 47 of the control device 40 so that the card memory stores the embroidery designs selected. This modification will provide convenience when an embroidery design that has been printed needs to be printed again.

Furthermore, a label tape for iron printing may be set in the tape cassette 21 and used to print character or embroidery designs, in order to make it easier to adhere the printed design to a cloth. This modification is suitable if there is a need to produce a design more efficiently and more economically than a stitched design.

While the invention has been described with reference to what is presently considered to be a preferred embodiment thereof, it is to be understood that the invention is not limited to the disclosed embodiment or structures. To the contrary, the invention is intended to cover various modifications and equivalent arrangements included within the spirit and scope of the appended claims.

What is claimed is:

1. A sewing machine having a label print function that is capable of producing stitches in a work cloth, comprising:

a machine body;

stitch forming means housed in the machine body for forming the stitches in the work cloth; and label printing means for printing information related to the stitches on an adhesive backed tape in lieu of or in addition to the formation of the stitches in the work cloth.

2. The sewing machine with a label print function according to claim 1, wherein the information related to stitches includes information usable to control the stitch forming means in order to form stitches.

3. The sewing machine with a label print function according to claim 1, wherein the information related to stitches includes embroidery design information for stitching an embroidery design, and wherein the label printing means prints the embroidery design.

4. The sewing machine with a label print function according to claim 1, further comprising:

design storage means in which information regarding a plurality of stitching designs is pre-stored;

design selecting means for selecting a stitching design from the stitching designs stored in the design storage means; and print information preparing means for reading information regarding the stitching design selected by the design selecting means from the design storage means and for preparing print information for printing the stitching design.

5. The sewing machine with a label print function according to claim 1, further comprising display means capable of indicating information related to a stitch formed by the stitch forming means, and print information preparing means for preparing print information to be used for printing on the basis of stitch-related information indicated by the display means.

6. The sewing machine with a label print function according to claim 4, wherein the label printing means prints on an iron-printable label.

7. The sewing machine with a label print function according to claim 6, further comprising stitching time calculating means for calculating a stitching time needed to produce a stitching design, and display means for indicating the stitching time calculated by the stitching time calculating means.

8. The sewing machine with a label print function according to claim 4, further comprising stitching design storage means for receiving information regarding a stitching design selected by the design selecting means and for continuing to store the information even after a supply of power is discontinued, and print information preparing means for preparing print information to be used for printing from the stitching design information stored in the stitching design storage means.

9. The sewing machine with a label print function according to claim 4, further comprising:

an external storage device for receiving and storing information regarding a stitching design selected by the design selecting device, the external storage device being detachably mounted in the sewing machine; and print information preparing means for reading stitching design information from the external storage device and for preparing print information to be used for printing.

10. The sewing machine with a label print function according to claim 4, wherein the information regarding a plurality of stitching designs stored in the design storage means includes information of a group of characters sorted separately for a plurality of typefaces, and wherein the design selecting means includes typeface selecting means for selecting a typeface and character selecting means for selecting a character.

11. The sewing machine with a label print function according to claim 4, wherein the information regarding a plurality of stitching designs stored in the design storage means includes information regarding a plurality of object designs.

12. A sewing machine having a pattern sewing capability, comprising:

a machine body;

a stitch forming mechanism housed in the machine body;

a controller for controlling operation of the sewing machine; and a print mechanism mounted in the machine body for printing a label identifying a selected sewing pattern.

13. The sewing machine according to claim 12, wherein the print mechanism is a tape printer for printing the identifying label.

14. The sewing machine according to claim 13, wherein the tape printer uses a tape selected from the group consisting of double-sided adhesive backed tape, iron-on tape, and iron transfer tape.

15. The sewing machine according to claim 13, wherein the print mechanism prints the identifying label containing one of a representation of the embroidery pattern being sewn, a description of the embroidery pattern being sewn, or an identification code for the embroidery pattern being sewn.

16. The sewing machine according to claim 12, further comprising a scanning device for scanning embroidery designs, the controller having means for developing a stitch pattern and print data for the identifying label.

17. The sewing machine according to claim 12, further comprising means for receiving externally stored embroidery data, the controller having means for developing print data for the identifying label from the embroidery data received.

18. The sewing machine according to claim 12, wherein the print mechanism comprises a tape feed mechanism and a discharge mechanism, the discharge mechanism discharging the printed label from the machine body in a direction so as not to interfere with operation of the stitch forming mechanism.

19. The sewing machine according to claim 12, further comprising selecting means for selecting among pattern types, patterns within pattern types, and type of label to be printed.

20. The sewing machine according to claim 1, wherein the label printing means is housed in the machine body.

21. The sewing machine according to claim 20, wherein the adhesive backed tape is housed in the label printing means.

22. The sewing machine according to claim 12, further comprising a display used in combination with the sewing machine.

23. The sewing machine according to claim 22, wherein the display is mounted in the machine body.

24. The sewing machine with a label print function according to claim 20, wherein the label printing means discharges a printed label in a direction away from a position of stitching by the stitch forming means.

* * * * *